US006552282B2

(12) United States Patent
Lewis

(10) Patent No.: US 6,552,282 B2
(45) Date of Patent: Apr. 22, 2003

(54) FLOATING BUTTON DESIGN FOR A HANDHELD COMPUTER

(75) Inventor: Todd Lewis, Mountain View, CA (US)

(73) Assignee: Palm, Inc., Santa Clara, CA (US)

( * ) Notice: Subject to any disclaimer, the term of this patent is extended or adjusted under 35 U.S.C. 154(b) by 0 days.

(21) Appl. No.: 09/957,192

(22) Filed: Sep. 19, 2001

(65) Prior Publication Data

US 2003/0051982 A1 Mar. 20, 2003

(51) Int. Cl.[7] ..... H01H 9/26
(52) U.S. Cl. ..... 200/5 A; 200/343
(58) Field of Search ..... 200/5 A, 118, 200/330, 332, 341, 343

(56) References Cited

U.S. PATENT DOCUMENTS

| | | | |
|---|---|---|---|
| 1,148,721 A | | 8/1915 | Scott |
| 3,612,802 A | | 10/1971 | Beadle et al. |
| 3,744,034 A | | 7/1973 | Paul |
| 4,132,877 A | | 1/1979 | Daigle |
| 4,315,114 A | | 2/1982 | Monti, Jr. |
| 4,323,740 A | | 4/1982 | Balash |
| 4,389,549 A | | 6/1983 | Brown |
| 4,396,963 A | | 8/1983 | Wright |
| D276,334 S | | 11/1984 | Dickerson |
| 4,819,893 A | | 4/1989 | Ueno |
| 4,860,372 A | | 8/1989 | Kuzunuki et al. |
| 4,887,129 A | | 12/1989 | Shenoy et al. |
| 4,972,496 A | | 11/1990 | Sklarew |
| 5,067,573 A | | 11/1991 | Uchida |
| 5,219,067 A | | 6/1993 | Lima et al. |
| 5,231,381 A | | 7/1993 | Duwaer |
| D338,191 S | | 8/1993 | Ahmed et al. |
| 5,293,018 A | | 3/1994 | Lander |
| 5,305,394 A | | 4/1994 | Tanaka |
| 5,329,276 A | | 7/1994 | Hirabayashi |
| 5,357,071 A | | 10/1994 | Seisakusho |
| 5,372,607 A | | 12/1994 | Stone et al. |
| 5,389,745 A | | 2/1995 | Sakamoto |
| 5,413,234 A | | 5/1995 | Hekal et al. |
| 5,423,227 A | | 6/1995 | Polaert et al. |
| 5,426,275 A | | 6/1995 | Maeda et al. |
| 5,434,929 A | | 7/1995 | Beernink et al. |
| 5,438,662 A | | 8/1995 | Randall |
| 5,444,192 A | | 8/1995 | Shetye et al. |
| 5,452,371 A | | 9/1995 | Bozinovic et al. |
| 5,481,074 A | * | 1/1996 | George ..... 200/343 |
| D369,143 S | | 4/1996 | Sorenson |
| 5,528,235 A | | 6/1996 | Lin et al. |
| 5,528,743 A | | 6/1996 | Tou et al. |
| 5,534,892 A | | 7/1996 | Tagawa |
| 5,560,475 A | | 10/1996 | Brundage et al. |
| 5,563,996 A | | 10/1996 | Tehao |
| 5,615,284 A | | 3/1997 | Rhyne et al. |
| 5,621,817 A | | 4/1997 | Bozinovic et al. |
| 5,629,832 A | | 5/1997 | Sellers |
| 5,629,837 A | | 5/1997 | Barabi et al. |
| 5,630,148 A | | 5/1997 | Norris |
| 5,698,822 A | | 12/1997 | Haneda et al. |
| 5,710,398 A | | 1/1998 | Hassler et al. |

(List continued on next page.)

OTHER PUBLICATIONS

Gray, R. et al., "Efficient MC68HC08 programming: reducing cycle count and improving code density", *Dr. Dobb's Journal*, vol. 20, No. 5, May 1995, pp 70–75.

(List continued on next page.)

*Primary Examiner*—Elvin Enad
*Assistant Examiner*—Lisa N Klaus
(74) *Attorney, Agent, or Firm*—Van Mahamedi; Hickman Palermo; Truong & Becker LLP

(57) ABSTRACT

A handheld computer includes a bar retained in an interior. A first button structure is accessible on an exterior surface of the handheld computer. A member joins to and extends between the bar and the first button structure. The member enables the first button structure to move into an actuated position without undergoing a radial motion about the bar.

40 Claims, 8 Drawing Sheets

U.S. PATENT DOCUMENTS

| | | | | |
|---|---|---|---|---|
| 5,718,326 | A | | 2/1998 | LaRose et al. |
| 5,724,492 | A | | 3/1998 | Matthews, III et al. |
| 5,734,130 | A | | 3/1998 | Baker |
| 5,749,457 | A | | 5/1998 | Cantaneda et al. |
| 5,825,675 | A | | 10/1998 | Want et al. |
| 5,841,901 | A | | 11/1998 | Arai et al. |
| 5,900,875 | A | | 5/1999 | Haitani et al. |
| 5,923,317 | A | | 7/1999 | Sayler |
| 5,927,483 | A | | 7/1999 | Yamada |
| 5,982,356 | A | | 11/1999 | Akiyama |
| 5,996,080 | A | | 11/1999 | Silva et al. |
| 6,034,685 | A | | 3/2000 | Kuriyama et al. |
| 6,064,342 | A | | 5/2000 | Sandhu et al. |
| 6,147,314 | A | * | 11/2000 | Han et al. ..... 200/343 |

OTHER PUBLICATIONS

Dayton, D., "FRx extends reporting power of Platinum Series", *PC Week*, vol. 8, No. 5, p 29(2), Feb. 1991.

Forbes, J., et al., "Palm PCs get a Big Hand (What's Hot)", *Windows Magazine*, No. 905, p 96, May 1998.

Penwarden, J., "More Muscle for HP's OminiBook", *Windows Magazine*, No. 501, p. 110, Jan. 1994.

Feigel, C., "IBM, Motorola preview embedded PowerPCs; 402 and 505 processors combine strong performance with low cost", *Microprocessor Report*, vol. 8, No. 6, pp 1–5, May 1994.

Bursky, D., "Evolving DSP chips do more", *Electronic Design*, vol. 38, No. 23, pp 51–59, Dec. 1990.

* cited by examiner

FLOATING BUTTON DESIGN FOR A HANDHELD COMPUTER

RELATED APPLICATIONS

This application is related to application Ser. No. 09/662,375, entitled "Button Pivot Bar," naming Amy Han, Ricardo Penate, Traci Neist, Robert G. Twiss as inventors. The aforementioned application is hereby incorporated by reference.

FIELD OF THE INVENTION

The present invention relates to handheld computers. In particular, the present invention relates to a handheld computer comprised of a button structure providing one or more floating buttons.

BACKGROUND OF THE INVENTION

Handheld computers, typically referred to as personal digital assistants (PDAs), are mobile devices used to operate personal information management programs. These programs include calendar applications, electronic phone books, and to-do lists.

FIG. 12 is a frontal view of a handheld computer. The handheld computer includes a housing 218 having a plurality of buttons 216. The buttons 216 are disposed on a surface of housing 218 near a display 214. The buttons are typically used to input data and actuate programs. Examples of handheld computers include PALM m100, PALM V, HANDSPRING VISOR, and RESEARCH IN MOTION BLACKBERRY, and COMPAQ IPAQ. Other handheld computers include mobile devices such as pagers and cell phones.

Several designs are currently in use for buttons on the handheld computer. Current designs include independently actuatable buttons that can be manipulated without affecting of other buttons. Some handheld computers, such as the PALM V, manufactured by PALM INC., use a button bar that forms a frame for a plurality of buttons. The button bar and buttons may be unitarily formed. The buttons are joined to the button bar by members. Each member deflects about the bar when the buttons are pressed. An example of this kind of button structure is disclosed in U.S. Pat. No. 6,147,314, hereby incorporated by reference.

The button bar configuration provides certain advantages over a configuration where the buttons are not interconnected, but independent. Among the advantages, the button bar enables all of the buttons for the handheld computer to be molded in a single process, thereby saving manufacturing costs and ensuring a consistent manufacturing quality.

FIG. 13 illustrates the possible motions for a button structure 240 about a bar 210, under the prior art. The button structure 240 may connect to bar 210 using a linear connecting member 220. When the button structure is pressed by a user, member 220 cantilevers, causing the button structure 240 to undergo a slight radial motion about bar 210. Variations in the normal radial motion of button structure 240 may be caused by flexing about bar 210. The radial motion of button structure 240 may cause it to lodge against the opening of the housing. Since the button structure 240 flexes when deviated, a bias may cause the button structure to get stuck against the edge of its opening, making the button difficult for the user to dislodge.

SUMMARY OF THE INVENTION

Embodiments of the invention provide for a button component on a handheld computer. The button component includes a bar and a plurality of members that extend outward from the bar to a plurality of button structures. Each member is joined to one of the button structures. The members that connect the button structures to the bar are shaped to have a linear length that is sufficient to enable the button structures to have a substantially linear motion when directed inward. The linear lengths of the members also permit the button structures to have some lateral freedom within their respective openings in the housing of the handheld computer. In addition, the amount of flexing about the bar is reduced by the shape of the members.

The button structure provides for integrally joined buttons that float within their respective openings in the housing of the handheld computer. The buttons can float because they can be moved laterally and vertically with minimal flexing about the bar that joins the buttons.

BRIEF DESCRIPTION OF THE DRAWINGS

Embodiments of the invention are illustrated by way of example, and not by way of limitation, in the figures of the accompanying drawings. Like reference numerals are intended to refer to similar elements among different figures.

DETAILED DESCRIPTION OF THE INVENTION

Figure 1:
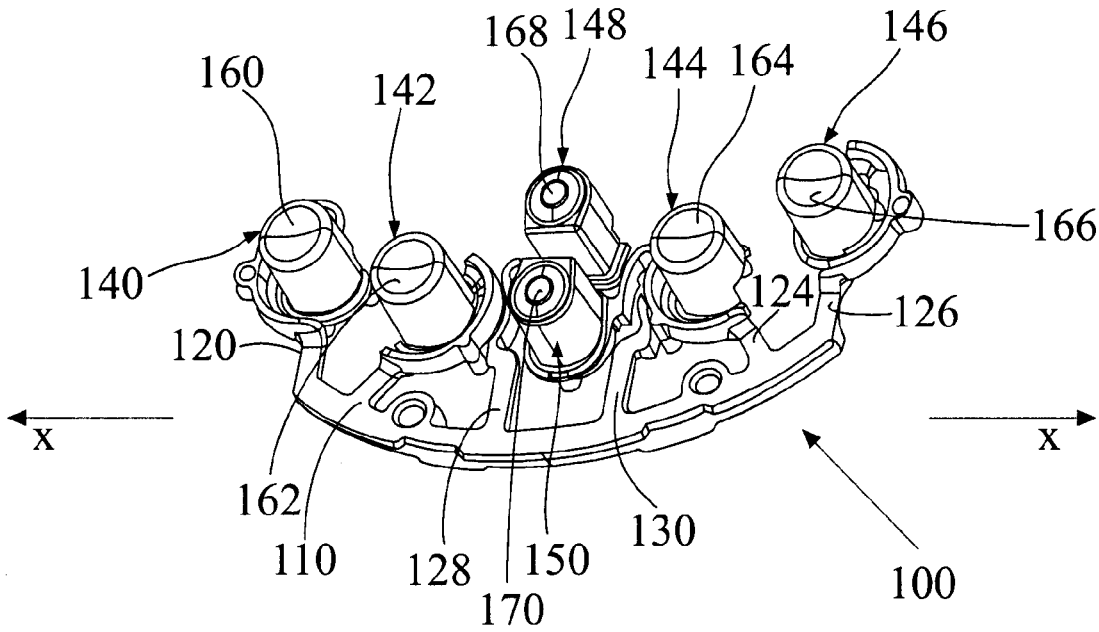
FIG. 1 is a front isometric view of a button component for a handheld computer.

Embodiments of the invention describe a handheld computer having integrally joined, floating buttons. In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

A. Overview

According to an embodiment of the invention, a button component for a handheld includes a bar, a plurality of button structures and a plurality of members that join the button structures to the bar. The bar is retained within a housing of the handheld computer. The button structures each include a button surface that is accessible to serve as a button for a user of the handheld computer.

According to an embodiment, each of the members join one of the button structures to the bar. Each of the members has a shape that enables that member to extend and retract. The members may be extended to enable corresponding button structures to have a substantially linear motion when traveling inward. In addition, the members may be extended to give the corresponding button structures freedom to move laterally.

In one embodiment, a linear length of each member that joins a button structure to a bar is greater than an effective length of that member. The added linear length may be accounted for by bending the member into a shape, and/or by joining the member to a perimeter point on the button structure that is not proximate to the bar.

As used herein, a linear length of a member corresponds to a member's length if that member was completely straight or unbent. An effective length of the member corresponds to a distance between opposing ends of the member in a bent state.

In another embodiment, each button structure includes a first perimeter point that is proximate to a point on the bar where the corresponding member is joined. The linear length of each corresponding member is greater than a distance between the first perimeter point and the bar. Each corresponding member may be joined to a button structure at a perimeter point that is radially spaced from the perimeter point, so as to add to the linear length of that member.

According to embodiments of the invention, the added linear length of each member joining one of the button structures to the bar is used to enable the button structures to travel in a more linear direction when moved inwards. The added linear lengths of those members also enable the buttons to have some movement in a lateral direction.

The button component may be unitarily formed. That is, the bar, the button structures and members may be formed using a manufacturing process that forms the bar, the button structures, and the member. In particular, the bar, the button structures and the member may be a single molded component, formed from plastic or metal.

The bar is a portion of the button component that is fixed within the housing and extends substantially in one direction. However, the bar may be curved or bent to accommodate a configuration of the button surfaces disposed on the housing of the handheld computer. The members are sections of the button component that extend from the bar at sharp or perpendicular angles. The members extend to the button structures. The button structures provide a surface that corresponds to the buttons for the handheld computer. The button structures have a depth that may be sufficient to enable the button surfaces to extend out of openings in the housing of the handheld computer.

Embodiments of the invention provide certain advantages. In particular, the member with the added length enables the button structures to travel a more unilateral direction into the handheld computer when the button surfaces are pressed by a user. In comparison, button structures of other handheld computers have a slightly radial movement that causes flexing in the member.

In addition, the added length of the member enables the button structures to have some lateral freedom within their respective openings. The lateral freedom can be used to dislodge the buttons from the edges of the openings if the user inadvertently directs the button against the side of its opening. In contrast, the slight radial travel of buttons in other handheld computers can cause the button surfaces to lodge against the edges of their openings, with sufficient bias to resist detachment from the edges.

Accordingly, an embodiment of the invention provides for at least one of the members to join and extend between the bar and the first button structure. The member enables the first button structure to move into an actuated position without the button structure having to undergo a measurable radial motion about the bar.

Measurable radial motion means that the center line of the button structure moves in a radial arc that displaces the center line by 1% or more in a lateral direction. The lateral direction is perpendicular to an axis of the button structure's motion.

B. Button Component For A Handheld Computer

FIG. 1 is a front isometric view of a button component for a handheld computer, under an embodiment of the invention. The button component includes a plurality of button surfaces. The button surfaces protrude from a housing of the handheld computer to provide a user with buttons that can be pressed to manipulate software and enter data.

Referring to FIG. 1, a button component 100 includes a bar 110, a plurality of members 120–130, and a plurality of button structures 140–150. Each button structure 140–150 is provided a button surface 160–170 that can be extended out of the handheld computer's housing. The disposition of the button structures 140–150 is primarily along an axis X. The bar 110 corresponds to a section of the button component 100 that extends primarily in the direction of X. The bar 110 may be curved or bent to conserve space, and to provide for a particular geometry for the button structures 140–150.

A first button structure 140 is joined to bar 110 by a first member 120. A second button structure 142 is joined to bar 110 by a second member 122. A third button structure 144 is joined to bar 110 by a third connecting member 124. A fourth button structure 146 is joined to bar 110 by a fourth member 126. A fifth button structure 148 is joined to bar 110 by a fifth member 128. A sixth button structure 150 is joined to bar 110 by a sixth member 130. Each member 120–130 connects to a base of the corresponding button structure.

In one configuration, button structures 140–146 correspond to application buttons, and button structures 148 and 150 correspond to scroll or navigation buttons. Other configurations are possible, with a greater or less number of button structures.

A user can actuate a switch corresponding to each of the button structures by pressing each button structure inward. The button surfaces 160–170 are what the user sees as the buttons. The buttons structures 140–150 are directed inward when the user presses corresponding button surfaces 160–170. In an embodiment, each button surface 160–170 is contoured inward, or concave about a center-line. The concavity of the buttons facilitate the button surfaces 160–170 in receiving contact from a stylus point.

Figure 2:
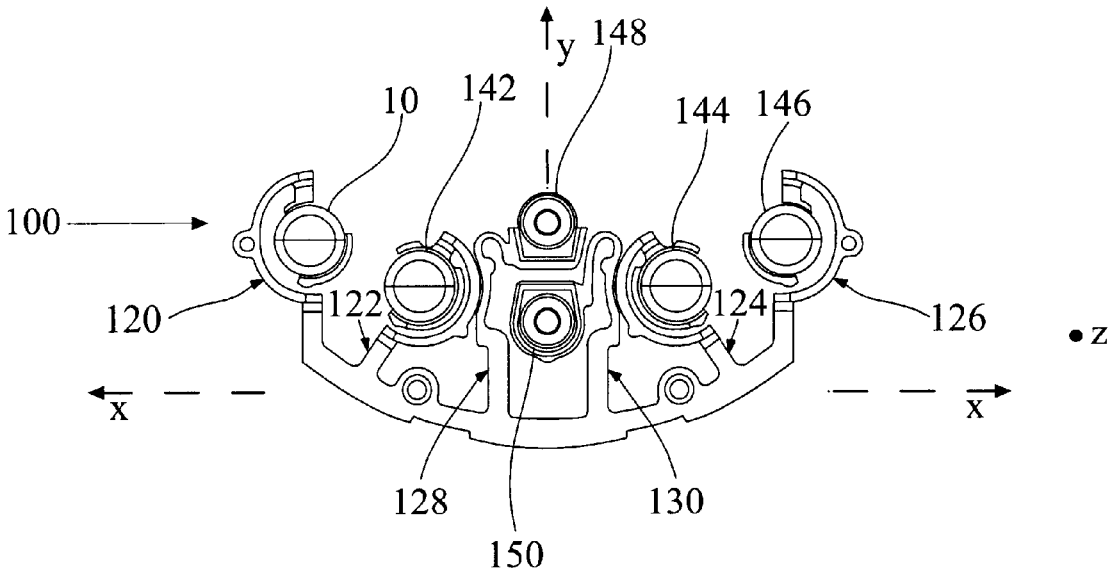
FIG. 2 is a top view of the button component.

FIG. 2 is a top view of the button component. The general direction of bar 110 and disposition of button structures 140–150 is along axis X. The buttons can be pushed inward, towards the interior of the handheld computer. The inward direction corresponds to an axis Z (into the paper). The buttons may vary in position along an axis Y. The sixth button structure 150 is positioned adjacent to fifth button structure 148 along the axis Y to provide a scrolling relationship between the two button structures.

FIG. 2 illustrates one embodiment where a linear length of members 120–130 is greater than a distance between the bar 110 and respective button structures 140–150. The added linear length of members 120–130 enables portions of those members to travel without appreciably flexing about bar 110. Numerous configurations are possible for button structures 140–150. In one embodiment, each member 120–130 is bent. The bent nature of the members 120–130 ensures that the linear length of each member is greater than the distance between the respective button structure 140–150 and the bar 110.

In one configuration, application buttons 140–146 are provided with members 120–126 that partially circumvent the button structures. The members 120–126 are formed into semi-circles that circumvent the button structures 140–146 up to about 180 degrees. The linear length of the semi-circular members 120–126 may be 50%–150% that it otherwise would be if those same members were extended linearly from bar 110 to proximate points of their corresponding button structures.

In other configurations, members 120–126 may have greater or lesser linear lengths. For example, some of the members 120–126 may extend a lesser radial segment around the corresponding button structure 140–146. Members 120–126 may partially circumvent only 45–90 degrees about corresponding button structures 140–146. This would still be sufficient to enable portions of those members to travel inward with the corresponding button structures 140–146 when those button structures are directed inward.

The fifth member 128 and sixth member 130 are used for the navigation buttons. The navigation buttons may correspond to fifth button structure 148 and sixth button structure 150. In many handheld computers, the navigation buttons are used to manipulate a display by scrolling content on the display upward or downward. To accomplish this, navigation buttons are often centrally disposed on the handheld computer, at a position that is proximate to the display. In addition, the navigation buttons are typically positioned vertically, adjacent to the display. In may handheld computers, navigation buttons are generally smaller than the application buttons (corresponding to button structures 140–146), and may be provided in a more cramped location between the other buttons.

To accommodate the limited space where navigation buttons are disposed, fifth members 128 and sixth members 130 are bent, but substantially elongated in one direction (along axis Y). The bending in fifth member 128 and sixth member 130 extends portions of those members in a direction along axis X. In an embodiment such as shown, sixth button structure 150 is disposed closer to bar 110 than fifth button structure 148. This geometry enables sixth member 130 to have a longer linear length than fifth member 128.

In an embodiment, one or more of the members 120–130 is extendible inward with the corresponding button structure 140–150. The added linear lengths of each member 120–130 enable portions of those members to travel inward without flexing about bar 110. In this way, the movement of members 120–130 reduces the flexing of the button structures 140–150, as well as of the members 120–130, about bar 110. The added linear lengths of members 120–130 enable the motion of the button structures 140–150 to be more linear (along axis Z), when directed inward. In addition, the added linear lengths of members 120–130 allow for button structures 140–150 to be moveable in both lateral directions (along axes X and Y).

If members 120–130 were linear and connected to proximate points of corresponding button structures so as to have no added linear lengths, the travel of the button structures 140–150 would have a more noticeable radial movement. The members 120–130 would be cantilevering off of bar 110 when the corresponding button structures are directed inward. Furthermore, the button structures 140–150 would lack the lateral movement provided by embodiments of this invention.

Figure 3:
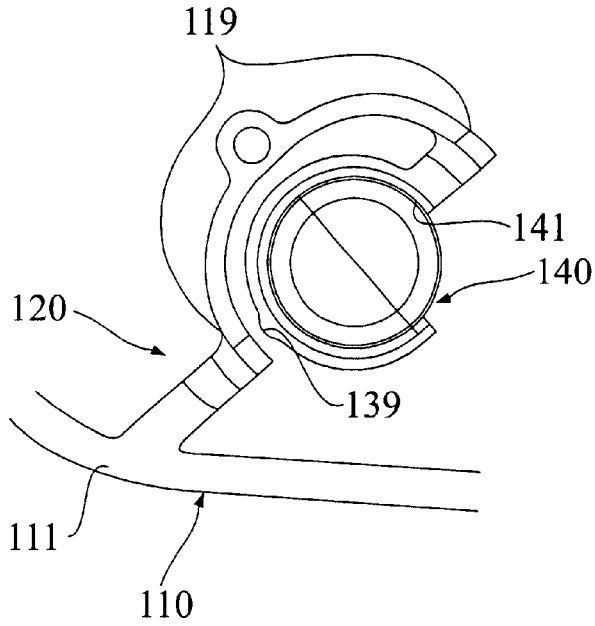
FIG. 3 is a close-up view of one of the button structures in the button component.

FIG. 3 is a close-up view of first button structure 140, under an embodiment of the invention. The first button structure 140 may be exemplary of other button structures, and specifically of button structures 142–146. The first button structure 140 has a first perimeter point 139 that is proximate to a point 111 on bar 110. The point 111 is where first member 120 joins the bar 110. The shortest possible length of first member 120 can be assumed to be the distance between first perimeter point 139 and point 111 of bar 110. The linear length of the first member 120 is longer than this distance.

In one embodiment, a second perimeter point 141 of first button structure 140 corresponds to where first member 120 joins first button structure 140. The first perimeter point 139 occupies a first radial position on first button structure 110, and second perimeter point 141 occupies a second radial position on first button structure 140. The first perimeter point 139 and second perimeter point 141 may be 180 degrees apart. The first member 120 may include a circular, bent portion 119 that partially circumvents first button structure 140.

The linear length of first member 120 includes the shape of bent portion 119, as well as a length to account for a difference between first and second perimeter point 139 and 141. By adding the bent portion 119, and by locating the second perimeter point 141 away from the first perimeter point 139, the linear length of member 120 is made to be greater than the distance between the button structure 140 and bar 110.

In an embodiment, bent portion 119 may correspond to a portion of first member 120 that travels inward (along axis Z) with first button structure 140 when the first button structure is directed inward. The added linear length provided by bent portion 119 enables button structure 140 to have lateral and vertical freedom of motion. In particular, button structure 140 can be directed linearly inward along axis Z, without a cantilevering motion that flexes bar 110.

In other embodiments, the second perimeter point 141 may be positioned closer to first perimeter point 139. For example, second perimeter point 141 may be positioned at 45 degrees, or 90 degrees from first perimeter point 139. In addition, bent portion 119 of first member 110 may be a non-circular shape, such as coiled or with right-angle bends.

Figure 4:
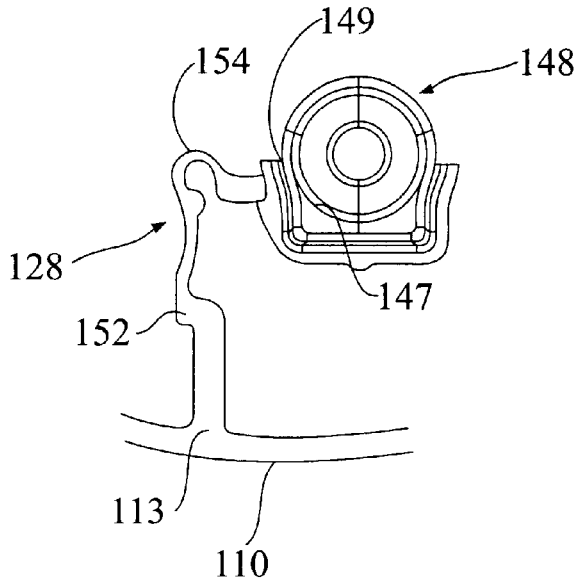
FIG. 4 is a close-up view of another one of the button structures in the button component.

FIG. 4 is a close-up view of fifth button structure 148, under an embodiment of the invention. The fifth button structure 148 has a first perimeter point 147 that is proximate to a point 113 of bar 110. The point 113 is where member fifth member 148 joins bar 110. The shortest possible length of fifth member 128 is would be the distance between the first perimeter point 147 and point 113. As with the other members, member 128 is bent to increase its linear length. In this way, the linear length of fifth member 128 is longer than the shortest distance between the button structure 148 and bar 110.

A second perimeter point 149 of fifth button structure 148 corresponds to where fifth member 128 joins the fifth button structure. The first perimeter point 147 may occupy a first radial position, and the second perimeter pint 149 may occupy a second radial position. In one implementation, first perimeter point 147 and second perimeter point 149 are between 0 and 45 degrees apart.

The fifth member 128 includes multiple bends, including a first bend 152 and a second bend 154. Each of the first and second bends 152, 154 correspond to where fifth member 128 extends along axis X. The second bend 154 is u-shaped. The first bend 152 and second bend 154 add to the overall linear length of fifth member 128. In this way, the linear length of fifth member 128 is greater than a distance between fifth button structure 148 and point 113 of bar 110. As with other button structures and members, the added linear length provided by fifth member 128 of member 120 enables fifth button structure 148 to have lateral and vertical freedom of motion.

Figure 5:
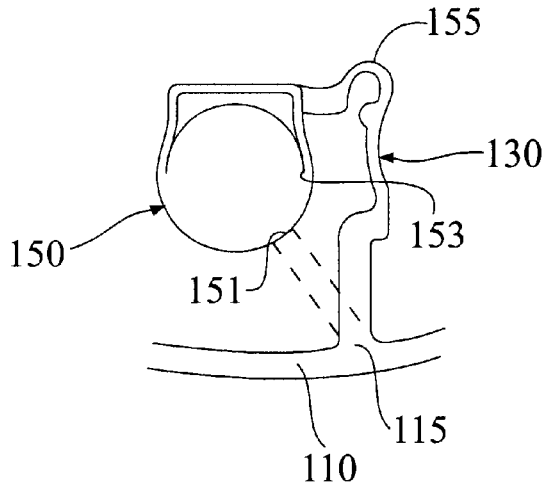
FIG. 5 is a close-up view of another one of the button structures in the button component.

FIG. 5 is a close-up view of sixth button structure 150, under an embodiment of the invention. The sixth button structure 150 is similar to fifth button structure 148 (FIG. 4), except sixth button structure 150 is positioned below the fifth button structure. The sixth member 130 has an elongated u-shaped extension 155 that extends to fifth button structure 148, and then back to sixth button structure 150. The elongated u-shaped extension 155 makes the linear length of sixth member 130 longer than a distance between the bar 110 and the sixth button structure 150.

The first perimeter point 151 of sixth member 130 is proximate to a point 115 on bar 110 where the sixth member is joined. The sixth member 130 joins sixth button structure 150 at second perimeter point 153. The linear length of sixth member 130 accounts for the difference between first perimeter point 151 and second perimeter point 153. In addition, the u-shaped extension 155 adds to the linear length of sixth member 130. The result is that the linear length of the sixth member 130 is longer than the distance between point 115 and first perimeter point 151.

The bent portions of members 120–130 enables the corresponding button structures 140–150 to have lateral and vertical freedom within openings where the button structures are retained. When the button component 100 is placed into the housing of handheld computer, the lateral motion of the button structures can be used to dislodge the button structures 140–150 from edges of their respective openings. The linear lengths of the members 120–130 give the feel that the buttons float within the housing of handheld computer.

Figure 6:
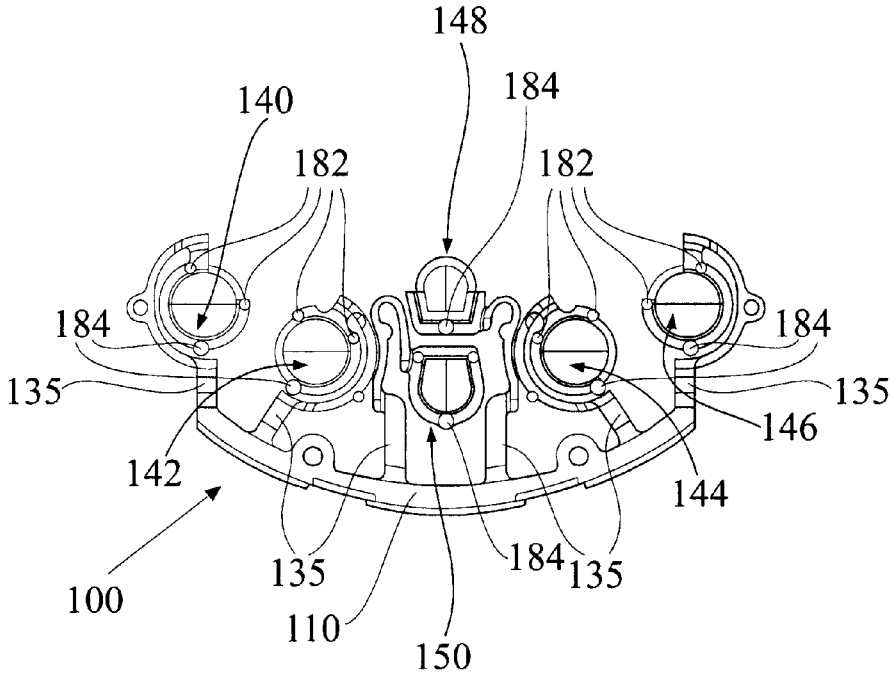
FIG. 6 is a bottom view of the button component.

FIG. 6 is a bottom view of button component 100. The bottom of each button structure 140–150 includes actuating extensions 182. When any one of the button structures 140–150 is directed inward, the actuating extension 182 of that button structure meets a conductive surface 192 (see FIGS. 7 and 8) to actuate a corresponding switch. Other extensions 184 act as over-travel stops for the button structures 140–150. The extensions 184 make contact with a support structure to prevent the actuating extension 182 from over-traveling and losing contact with the conductive surface 192.

In an embodiment, the button component 100 is unitarily formed. That is, one molding process is used to form the button component 100. To facilitate members 120–130 in bending and traveling with corresponding button structures 140–150, the members 120–130 are provided a variable thickness as they extend from bar 110 to their respective button structures 140–150. The variable thickness may be provided by twisting rectangular cross-sectioned strips forming members 120–130. The thicker portions of members 120–130 may be located where less flexibility or travel is desired.

In one embodiment, each member 120–130 includes a base stem 135 that has the greater thickness of that member. Each member 120–130 also includes one or more bent portions (see e.g. bent portion 131 of FIG. 3) having lesser thicknesses. The lesser thicknesses of the bent portions promote bending of those bent portions when corresponding button structures 140–150 are directed inward. The base stem 135 remain relatively static when the button structure is directed inward. Sections of each member adjacent to the corresponding button structures 140–150, may also be twisted to have a greater thickness, thereby reducing bending of the members 120–130 near the corresponding button structures when those button structures travel. In this way, intermediate portions of members 120–130, between bar 110 and corresponding button structures 140–150, are what bend when the corresponding button structures are directed inward. This helps the button structures to have a substantially linear motion when pushed.

C. Handheld Computer With Button Component

Figure 7:
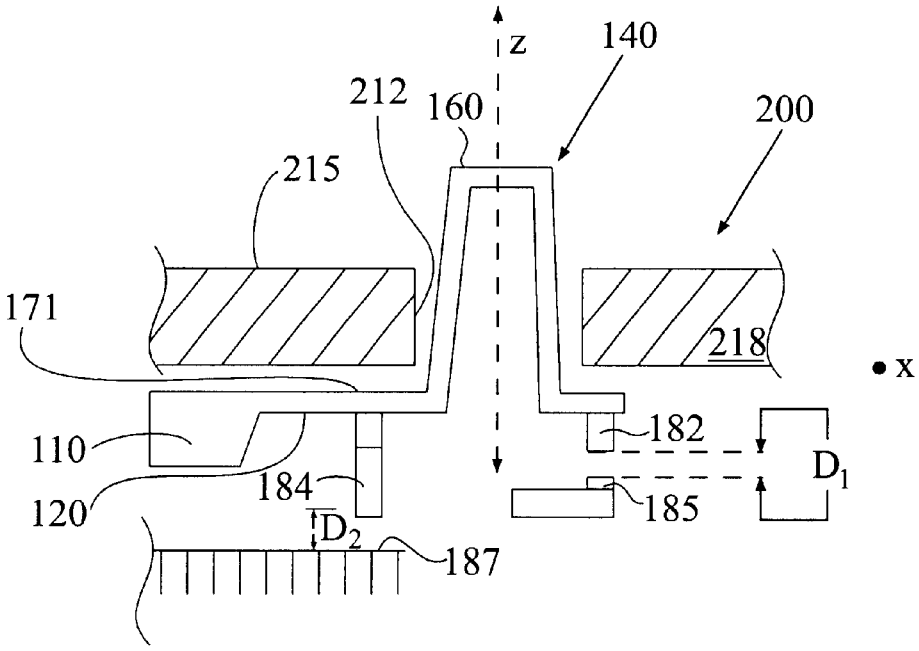
FIG. 7 is a side cross-sectional view of a button structure in a housing of a handheld computer, where the button structure being in a raised position.
Figure 8:
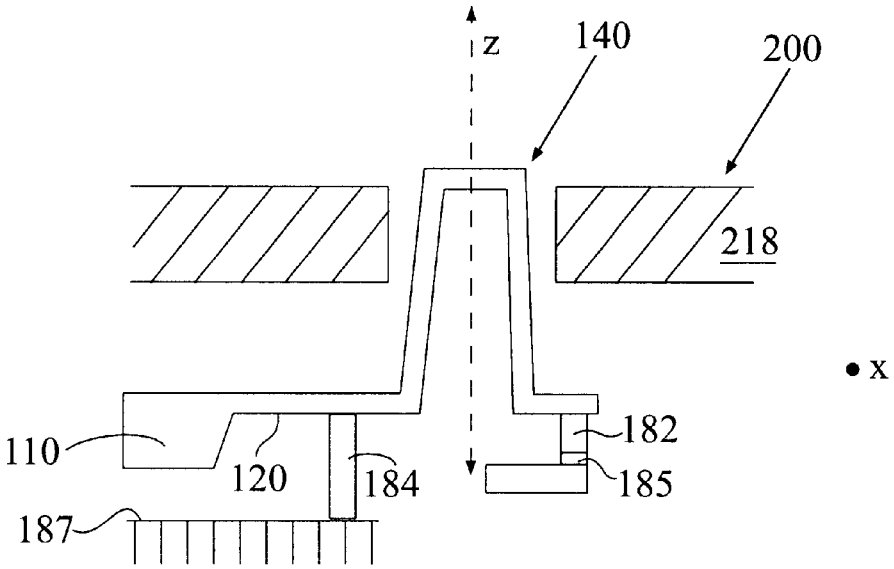
FIG. 8 is a side cross-sectional view of the button structure in the housing of the handheld computer, where the button structure being in a lowered position.

FIGS. 7 and 8 illustrate button structures traveling within the housing of the handheld computer. For illustrative purposes, first button structure 140 is described in FIGS. 7 and 8. The description provided for first button structure 140 is equally applicable to the other button structures 142–150.

FIG. 7 illustrates button structure 140 in a raised position. The bar 110 is mounted within a housing 218 of handheld computer 200 (See FIG. 9). The first button structure 140 is positioned so as to extend from an opening 212 in the housing 218. The first button structure has a height to extend past an exterior surface 215 of the housing 218. The axis Z is shown extending normally from button surface 160.

The bar 110 extends along axis X (out of the paper). The member 120 extends from bar 110 to a base 171 of button structure 140. The member 120 includes a bent portion 131 that is not viewable from this angle. The member 120 joins first button structure 140 at or near base 171. The first button structure 140 includes actuating extension 182, aligned to make contact with an electrical surface 185. A distance D1 separates the actuating extension 182 from the electrical surface 185. The first button structure 140 also includes over-stop extension 184. The extension 184 is aligned to make contact with a stop 187. A distance D2 separates the second extension 184 from stop 187. The distance D2 may be slightly longer than distance D1, so that second extension 184 makes contact with stop 187 after actuating extension 182 makes contact with electrical surface 185.

FIG. 8 illustrates button structure 140 in a lowered or actuated position. In the lowered position, extension 182 makes contact with electrical surface 185. The second extension 184 is positioned to be slightly separated from stop 187. If button structure 140 is pushed so as to pivot about extension 182, extension 184 contacts stop 187 and stabilizes the button structure by preventing further pivoting.

In the lowered position, a portion of first member 120 bends to enable first button structure 140 to travel in a substantially linear direction along axis Z. The first button structure 140 can be directed inward without radial movement about bar 110. A portion of first member 120 bends and travels with first button structure 140 to enable the substantially linear motion. A portion of first member 120 near the bar 110 remains substantially undeformed when the first button structure 140 is directed inward.

D. Motion of Button Structure

Figure 9:
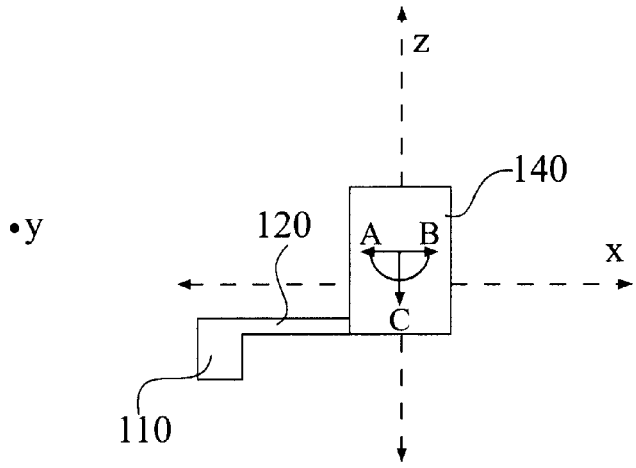
FIG. 9 is a motion diagram for one of the button structures in the button component.
Figure 13:
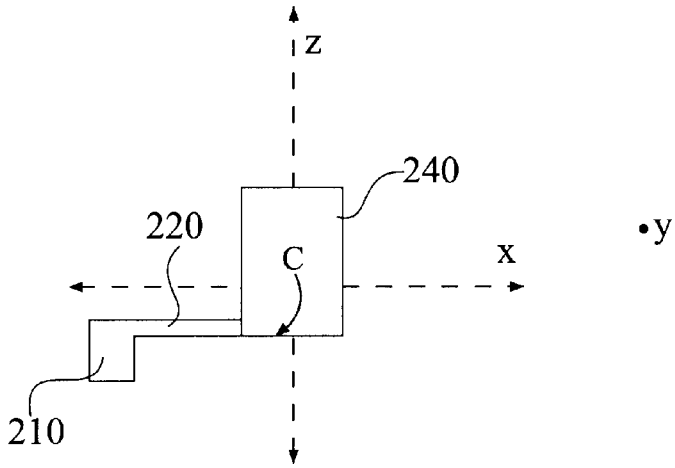
FIG. 13 (PRIOR ART)
FIG. 13 illustrates a handheld computer that can be used with an embodiment of the invention.

FIG. 9 is a motion diagram illustrating the freedom of motion for first button structure 140 within a corresponding housing opening. The description of the movement of first button structure 140 may be applicable to the other button structures as well.

The arrows in FIG. 9 illustrate possible motions for first button structure 140. As shown, first button structure 140 is capable of linear motion about axis Z. In addition, first button structure 140 is capable of lateral motion along axes X and Y (out of the paper). The different motions of the button structure is made possible by the linear length of first member 120. The first member 120 can deform, bend and travel with the first button structure so that first button 140 can maintain a linear motion, with little flex on bar 110. In particular, first button member 140 can be directed inward, into a lowered or actuated position, without any measurable radial motion about the bar 110. The linear length and mobility of first member 120 also enables first button structure 140 to move laterally within the opening 212 of the handheld computer 200.

Figure 12:
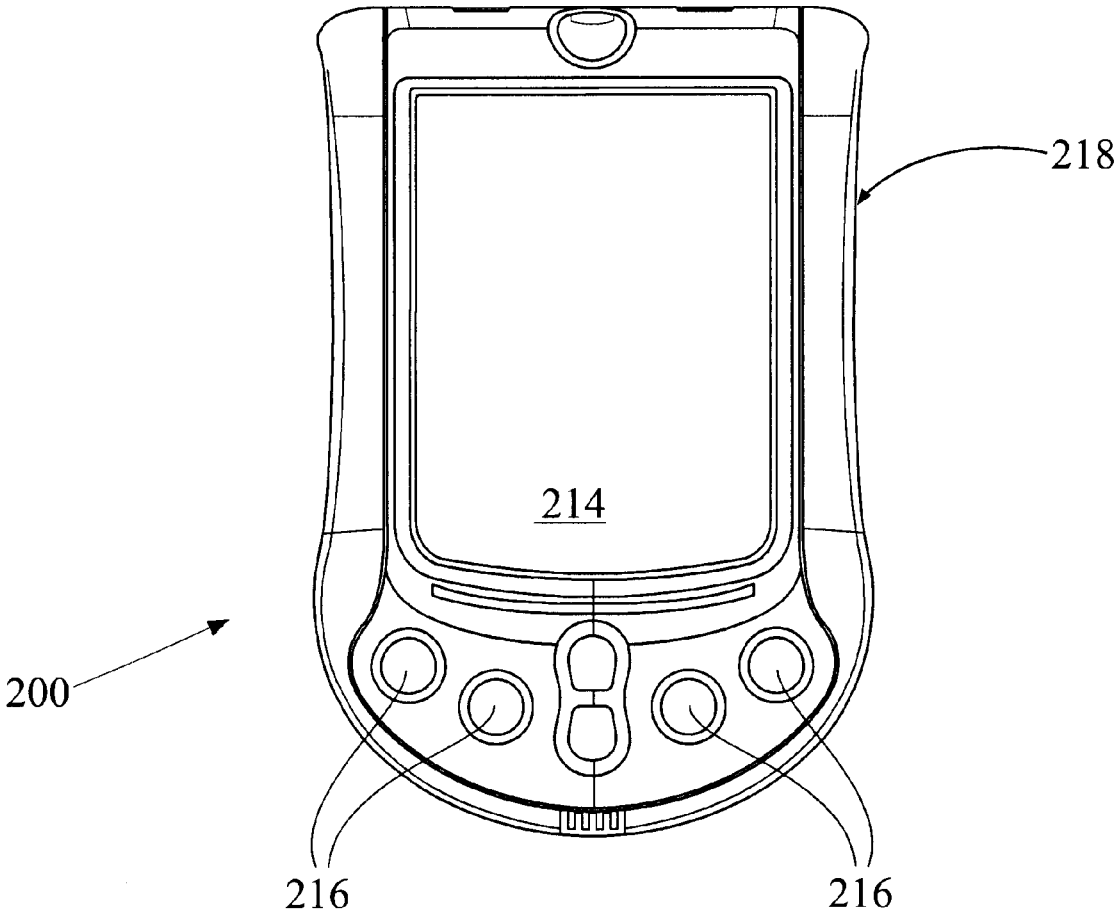
FIG. 12 (PRIOR ART)
FIG. 12 is a motion diagram of a button structure on a prior-art button component.

In comparison, the motion of button structures in known button components is limited, and measurably radial (see FIG. 12).

E. Alternative Embodiments

Figure 10:
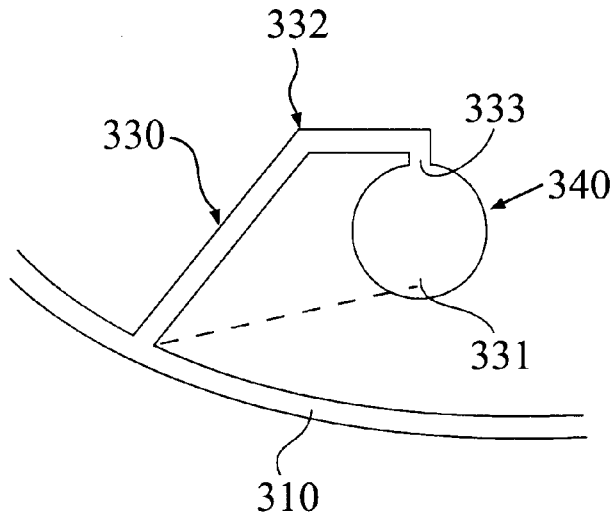
FIG. 10 is a frontal view of a button structure and member joined to a button bar, under another embodiment of the invention.
Figure 11:
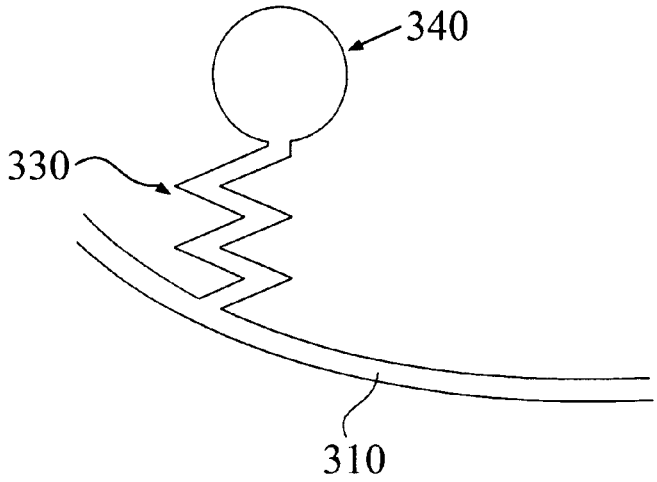
FIG. 11 is a frontal view of a button structure and member joined to a button bar, under another embodiment of the invention.

FIGS. 10–11 illustrate alternative configurations for a member that connects to a button structure 340 of handheld computer 200. In FIG. 10, a member 330 is one bend 332, but is extended from bar 310 so that its linear length is substantially more than required if a linear segment was extended from the bar 310 to a proximate point 331. The connection point 333 between the member 330 and the button structure 340 may be apart from where the proximate point 331 is, so as to add to the linear length of the member 330.

FIG. 11 illustrates another embodiment where member 330' is zig-zagged to provide it with sufficient linear length to enable the button structure to have a substantially linear motion. Other configurations for the shape of members joining button structures to the bar can be contemplated.

F. Conclusion

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A handheld computer comprising:

a housing including a front exterior surface;

a bar retained within the housing;

a first button structure accessible on the front exterior surface; and a member that joins to and extends between the first button structure and the bar, the member being shaped to extend its effective length when the first button structure is directed inward along a first axis, or laterally along a second axis that is perpendicular to the first axis;

wherein the first button structure has a first perimeter point that is proximate to the bar, and wherein a linear length of the member is greater than a distance between the first perimeter point and the bar.

2. The handheld computer of claim 1, wherein the member joins the first button structure at a second perimeter point that is different than the first perimeter point.

3. The handheld computer of claim 2, wherein the first perimeter point has a first radial position, the second perimeter point has a second radial position, and wherein the second radial position is more than 90 degrees apart from the first radial position.

4. The handheld computer of claim 2, wherein the first perimeter point has a first radial position, the second perimeter point has a second radial position, and wherein the second radial position is about 180 degrees apart from the first radial position.

5. A handheld computer comprising:

a housing including a front exterior surface;

a bar retained within the housing;

a first button structure accessible on the front exterior surface; and a member that joins to and extends between the first button structure and the bar, the member being shaped to extend its effective length when the first button structure is directed inward along a first axis, or laterally along a second axis that is perpendicular to the first axis;

wherein a shape of the member includes a bend that at least partially circumvents the button structure, the bend deflecting inward when the button structure is directed inward.

6. The button component claim 5, wherein the member is bent so that the linear length of that member is at least 20% greater than the distance between a first perimeter point where the first button structure is proximate to the bar and the bar.

7. The button component of claim 5, wherein the member is bent so that the linear length of that member is at least 50% greater than the distance between a first perimeter point where the first button structure is proximate to the bar and the bar.

8. The button component of claim 5, wherein the bar, the first button structure, and the member are unitarily formed.

9. The button component of claim 5, wherein the member is twisted so that the member has a varying thickness along a linear length of that member.

10. The handheld computer of claim 1, wherein the member is bent so that the linear length of the member is at least 20% greater than the distance between the first perimeter point and the bar.

11. The handheld computer of claim 10, wherein the member is bent so that the linear length of the member is at least 50% greater than that of the distance between the first perimeter point and the bar.

12. The handheld computer of claim 1, wherein the first button structure has a base and extends a height from the base to a button surface, the button surface being accessible on the front exterior surface, and wherein the member joins the button structure at or proximate to the base.

13. A handheld computer comprising:

a housing including a front exterior surface;

a bar retained within the housing;

a first button structure accessible on the front exterior surface; and a member that joins to and extends between the first button structure and the bar, the member being shaped to extend its effective length when the first button structure is directed inward along a first axis, or laterally along a second axis that is perpendicular to the first axis;

wherein a shape of the member has a curvature along a length that at least partially circumvents the button structure.

14. The button component of claim 13, wherein the member is bent so that the length of the member is at least 20% greater than the distance between a first perimeter point where the first button structure is proximate to the bar and the bar.

15. The button component of claim 13, wherein the member is bent so that the length of the member is at least 50% greater than the distance between a first perimeter point where the first button structure is proximate to the bar and the bar.

16. The button component of claim 13, wherein the bar, the first button structure, and the member are unitarily formed.

17. The button component of claim 13, wherein the member is twisted so that the member has a varying thickness along its length.

18. A handheld computer comprising:

a housing including a front exterior surface;

a bar retained within the housing;

a first button structure accessible on the front exterior surface; and a member that joins to and extends between the first button structure and the bar, the member being shaped to extend its effective length when the first button structure is directed inward along a first axis, or laterally along a second axis that is perpendicular to the first axis;

wherein a shape of the member includes a semi-circular length that circumvents a base of the first button structure.

19. The button component of claim 18, wherein the member is bent so that the length of that member is at least 20% greater than the distance between a first perimeter point where the first button structure is proximate to the bar and the bar.

20. The button component of claim 18, wherein the member is bent so that the length of the member is at least 50% greater than the distance between a first perimeter point where the first button structure is proximate to the bar and the bar.

21. The button component of claim 18, wherein the bar, the first button structure, and the member are unitarily formed.

22. The button component of claim 18, wherein the member is twisted so that the member has a varying thickness along its length.

23. The handheld computer of claim 1, wherein the bar, the member and the first button structure are unitarily formed.

24. The handheld computer of claim 1, wherein the member has one or more bends configured so that a linear length of the member is sufficient to enable at least a portion of the member to travel inward with the first button structure when the first button structure is directed inward.

25. The handheld computer of claim 1, wherein a portion of the member is twisted so that the member has a varying thickness along the linear length.

26. The handheld computer of claim 25, wherein a thickness of the member is greatest along a segment that circumvents the first button structure.

27. The handheld computer of claim 1, wherein the first button structure includes:

a base;

a first extension extending from the base to make contact with an electrical surface and to actuate an electrical signal when the first button structure is pushed inward; and a second extension that is longer than the first extension, a length of the second switch having a sufficient length to resist the first button structure from tilting after the first extension makes contact with the electrical surface.

28. A handheld computer comprising:

a bar retained in an interior of the handheld computer;

a first button structure accessible on an exterior surface of the handheld computer; and a member that joins to and extends between the bar and the first button structure, the member enabling the first button structure to move into an actuated position without the first button structure having to undergo a measurable radial motion about the bar;

wherein the member partially circumvents the first button structure.

29. The handheld computer of claim 28, wherein the member is a circular and joins to the first button structure in one or more connection points.

30. A handheld computer comprising:

a housing including a front exterior surface;

a bar retained within the housing;

a plurality of button structures accessible on the front exterior surface, each of the plurality of button structures having a first perimeter point that is proximate to the bar; and a plurality of members, each member extending to join one of the plurality of button structures with the bar, each member having a linear length that is greater than a distance between the first perimeter point and the bar, and each member being extendible inward when the corresponding joined button structure is directed inward.

31. The handheld computer of claim 30, wherein each member joins one of the plurality of button structures at a second perimeter point, and where in the second perimeter point is different than the first perimeter point for that button structure.

32. The handheld computer of claim 31, wherein the first perimeter point of each button structure has a first radial position, the second perimeter point of each button structure has a second radial position, and wherein for each button structure, the second radial position is more than 90 degrees apart from the first radial position.

33. The handheld computer of claim 30, wherein each member at least partially circumvents the joining button structure.

34. The handheld computer of claim 30, wherein at least some of the members are bent so that the linear length of each bent member is at least 20% greater than the distance between the first perimeter point of the joining button structure and the bar.

35. The handheld computer of claim 30, wherein at least some of the members are bent so that the linear length of each bent member is at least twice that of the distance between the first perimeter point of the joining button structure and the bar.

36. A button component for a handheld computer, the button component comprising:

a bar retained within a housing of the handheld computer;

a plurality of button structures accessible on the front exterior surface, each of the plurality of button structures having a first perimeter point that is proximate to the bar; and a plurality of members, each member extending to join one of the plurality of button structures with the bar, each member having a linear length that is greater than a distance between the first perimeter point and the bar, and each member being extendible inward when the joining button structure is directed inward.

37. The button component of claim 36, wherein each of the plurality of members are bent so that the linear length of that member is at least 20% greater than the distance between the first perimeter point of the button structure that joins to that member and the bar.

38. The button component of claim 36, wherein each of the plurality of members are bent so that the linear length of that member is at least 50% greater than the distance between the first perimeter point of the button structure that joins to that member and the bar.

39. The button component of claim 36, wherein the bar, the plurality of button structures, and the plurality of members are unitarily formed.

40. The button component of claim 36, wherein at least one of the plurality of members is twisted so that the member has, a varying thickness along its linear length.

* * * * *